US009303835B2

(12) United States Patent
Wang

(10) Patent No.: US 9,303,835 B2
(45) Date of Patent: Apr. 5, 2016

(54) FLASHING LIGHTING MODULE

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 45 days.

(21) Appl. No.: 14/462,588

(22) Filed: Aug. 19, 2014

(65) Prior Publication Data

US 2016/0053955 A1 Feb. 25, 2016

(51) Int. Cl.

| | |
|---|---|
| ***F21V 21/00*** | (2006.01) |
| ***F21V 35/00*** | (2006.01) |
| ***F21S 10/06*** | (2006.01) |
| ***F21S 10/02*** | (2006.01) |
| ***F21S 6/00*** | (2006.01) |
| ***F21S 10/00*** | (2006.01) |
| ***F21S 8/00*** | (2006.01) |
| ***F21V 23/00*** | (2015.01) |
| *F21W 121/00* | (2006.01) |

(52) U.S. Cl.

CPC ..... *F21S 10/06* (2013.01); *F21S 6/001* (2013.01); *F21S 8/035* (2013.01); *F21S 10/005* (2013.01); *F21S 10/023* (2013.01); *F21V 23/003* (2013.01); *F21W 2121/00* (2013.01)

(58) Field of Classification Search

CPC ..... F21S 6/001; F21S 8/035; F21S 10/005; F21S 10/023; F21S 10/04; F21S 10/043; F21S 10/046; F21S 10/06; F21V 23/003

USPC ..... 362/249.16, 311.13, 392–393, 605, 810

See application file for complete search history.

(56) References Cited

U.S. PATENT DOCUMENTS 6,712,493 B2 * 3/2004 Tell ..... G02B 6/0021 362/237

* cited by examiner

*Primary Examiner* — Jason Moon Han

(74) *Attorney, Agent, or Firm* — Leong C. Lei

(57) ABSTRACT

A flashing lighting module includes: a base, a light guide unit, and a control circuit. The light guide unit includes at least two light-transmitting plates, each of which has an end forming a fixing section. The fixing sections are respectively received in corresponding mounting holes formed in the base and each includes a light incident surface at the side thereof opposite to the light-transmitting plate. The control circuit includes two light-emitting elements respectively corresponding to the light-transmitting plates and is connectable to a power supply for driving the two light-emitting elements to get lightening and darkening in sequence. As such, when a power supply is conducted on, each of the light-emitting elements gives off light transmitting to the interiors of the light-transmitting plates to make each of the light-transmitting plates show an effect of flashing in response to the lightening and darkening of the corresponding one of the light-emitting elements.

6 Claims, 13 Drawing Sheets

FLASHING LIGHTING MODULE

TECHNICAL FIELD OF THE INVENTION

The present invention generally relates to a lighting device, and more particularly to a structure that provides a flashing effect.

DESCRIPTION OF THE PRIOR ART

With the change of living style and the improvement of the economic environment, people have increasingly diversified needs for decoration of the living space. People often use lighting devices of various types and styles to build up a desired atmosphere.

A commonly used light bulb is formed by arranging a tiny tungsten filament in a glass enclosure from which are is evacuated and chemical inertial gas, such as nitrogen and argon, is filled in the enclosure for substitute. Through supply of electrical power, an electrical current flows through the tungsten filament and generates a temperature as high as 2,500° C. that emits light. Another type bulb, which is related to the present invention, is referred to as a "flame bulb", which comprises two metal plates that are arranged inside a glass enclosure in a spaced manner and lights is emitted from an electric arc generated therebetween.

However, for whatever type of the bulb may be, it gives a single color of light and change of the light color is generally impossible. The color can be modified by only addition of a cover set outside and housing the bulb.

SUMMARY OF THE INVENTION

An object of the present invention is to provide a lighting module, which comprises a design with an innovated structure for substitute of the known flame bulb.

Thus, the present invention provides a flashing lighting module, which comprises:

a base, which comprises at least two spaced and position-alternating mounting holes formed therein;

a light guide unit, which comprises at least two light-transmitting plates, each of the light-transmitting plates being a board having a thickness to allow light to transmit therethrough and having an end from which a fixing section extends, the fixing sections being respectively received in the corresponding ones of the mounting holes, the fixing sections each comprising a light incident surface at the side thereof opposite to the light-transmitting plate; and a control circuit, which comprises a control substrate, at least two light-emitting elements, and a connection wire, the light-emitting elements respectively corresponding to the light incident surfaces and electrically connected to the control substrate and the connection wire, the connection wire being connected to a power supply to receive electricity therefrom in order to control the control substrate to drive each of the light-emitting elements to lighten and darken in a predetermined timing sequence.

As such, when the power supply is conducted on, each of the light-emitting elements gets lightening and darkening in a given sequence and lights pass through the light incidence sections into the interiors of the light-transmitting plates so that the light-transmitting plates show a flashing effect in response to the lightening and darkening of the light-emitting elements.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
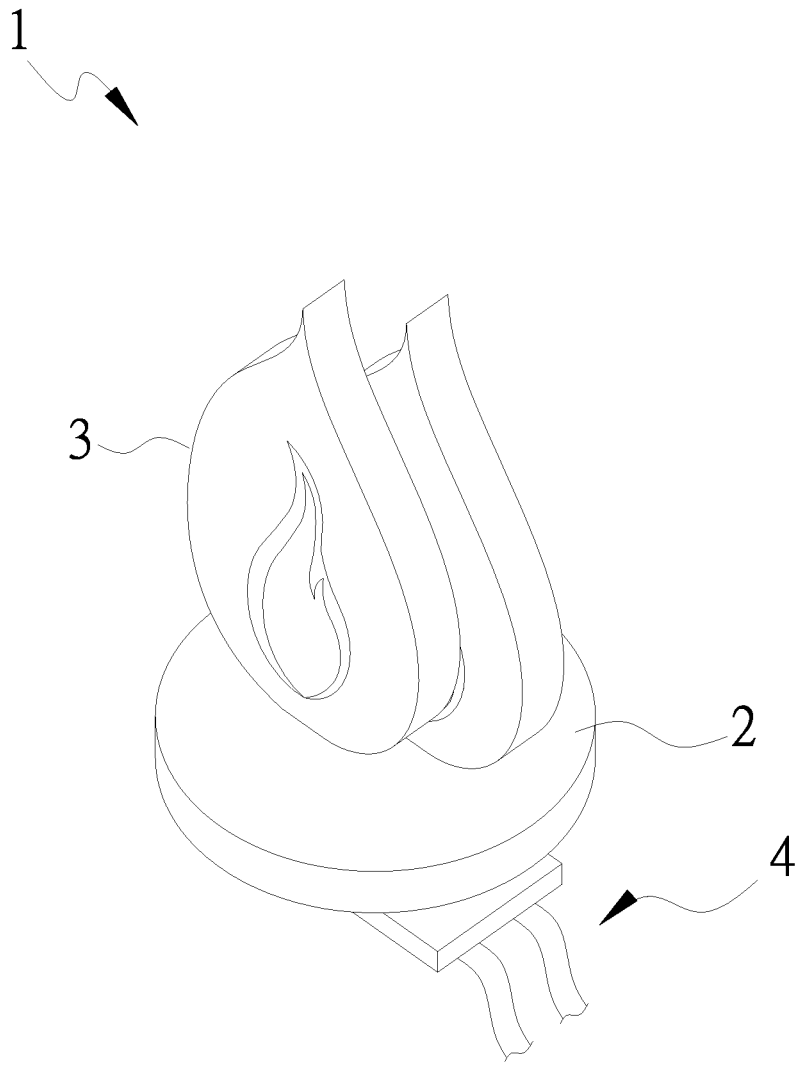
FIG. 1 is a perspective view showing the present invention in an assembled form.
Figure 2:
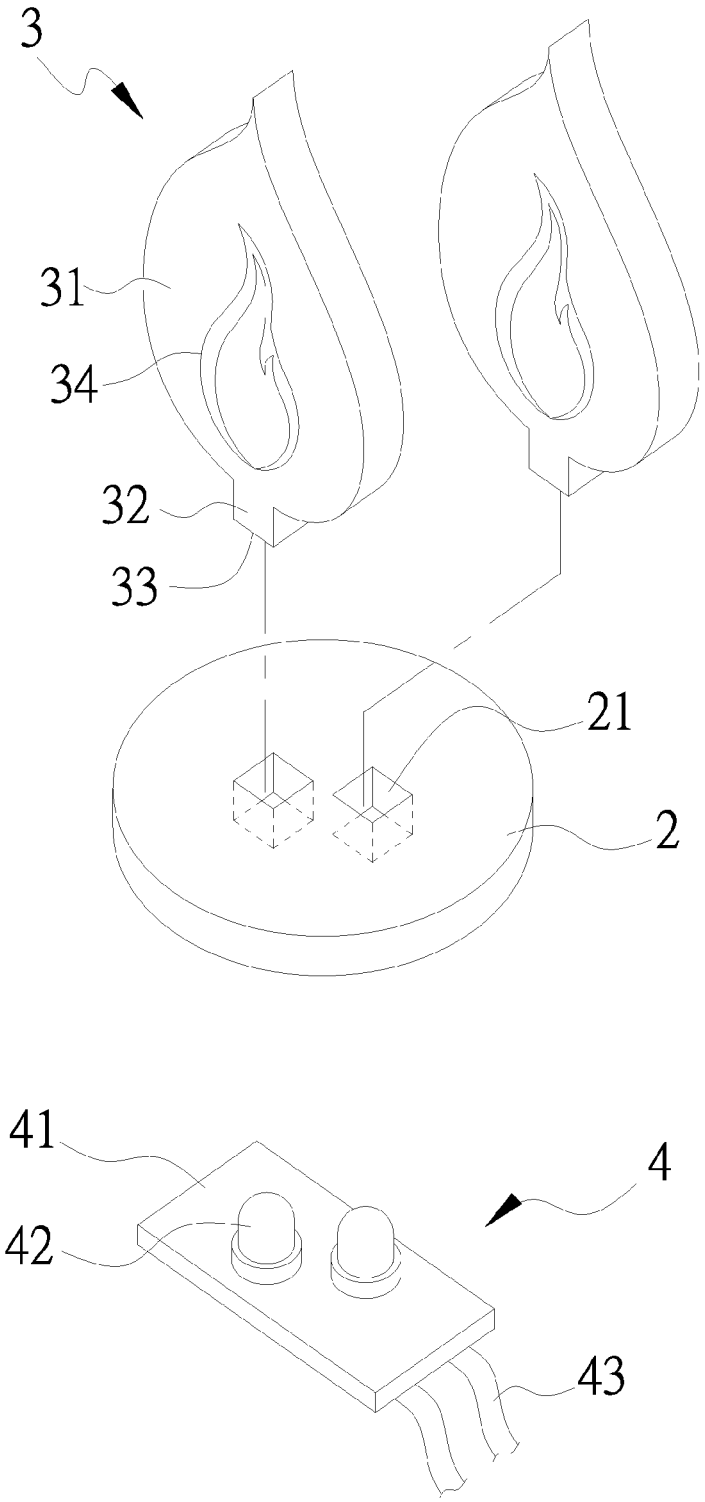
FIG. 2 is an exploded view of the present invention.
Figure 3:
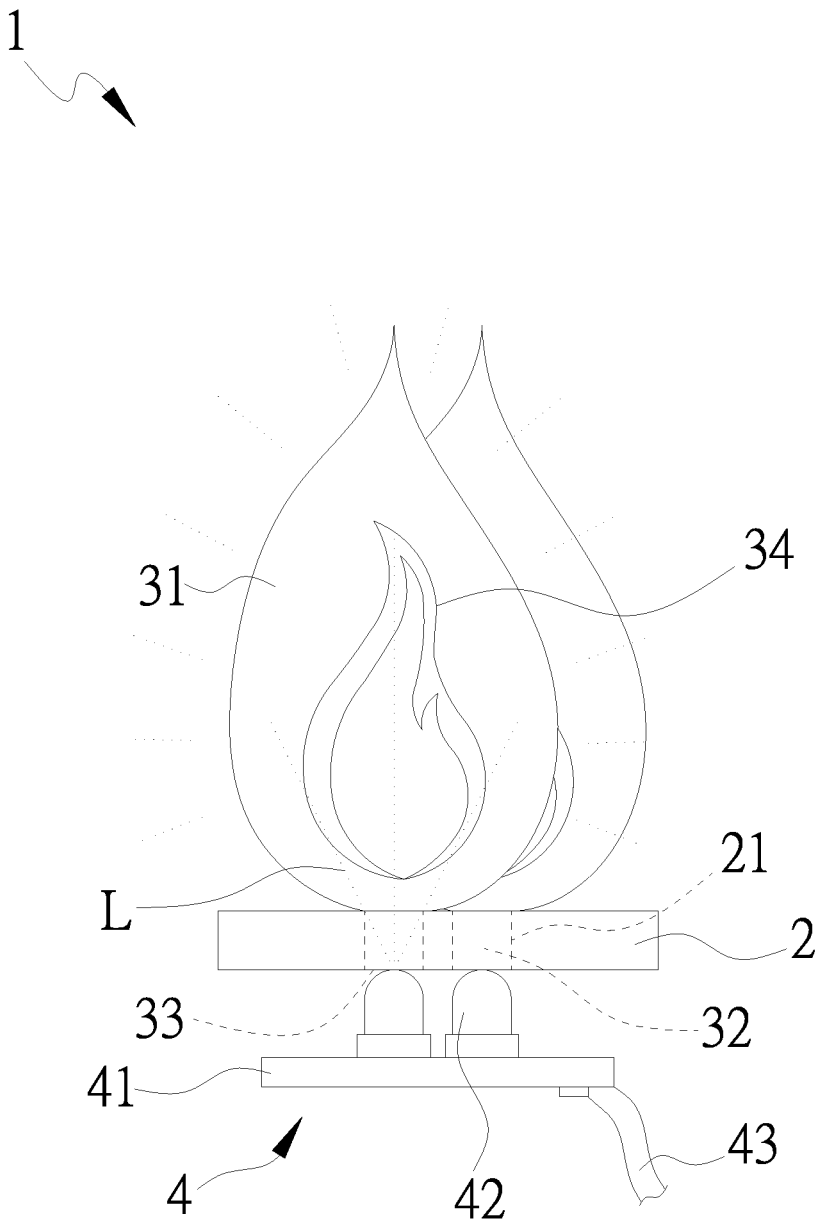
FIGS. 3 and 4 are schematic views showing the use of the present invention.
Figure 4:
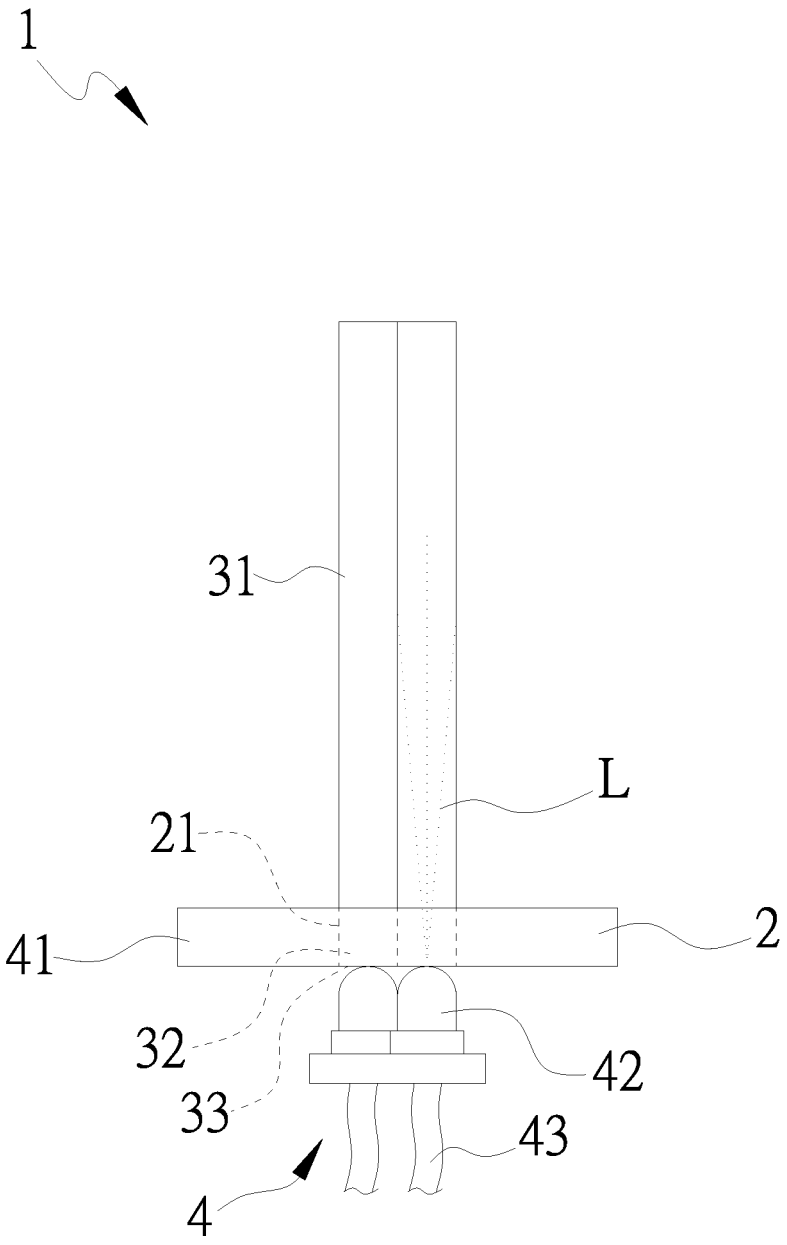

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-4, a flashing lighting module (1) according to the present invention is provided as a lighting device usable in an environmental space and is particularly applicable to a small night light or an electronic candle. The lighting module (1) generally comprises: a base (2), a light guide unit (3), and a control circuit (4). The light guide unit (3) and the control circuit are respectively set at opposite sides of the base (2).

The base (2) comprises at least two mounting holes (21) that are arranged to space from each other. In the instant embodiment, the base (2) is not limited to any specific shape and may be for example a geometric shape, such as circle and polygon. The base is also not limited to any specific material and may be made of for example metals or plastics and is preferably of a structure that does not allow for transmission of light therethrough.

The light guide unit (3) comprises at least two light-transmitting plates (31). Each of the light-transmitting plates (31) comprises a flat board that has a thickness allowing light to transmit therethrough and has an end from which a fixing section (32) extends. The fixing section (32) is received in a corresponding one of the mounting holes (21). The fixing section (32) comprises a light incident surface (33) at the side opposite to the light-transmitting plate (31). In the instant embodiment, the light-transmitting plate (31) has a shape of a flame and the fixing section (32) is in the form of a rectangular post, but they are not limited to such configurations and may be made of a light-transmitting material, such as glass and plastics. Colorants may be added in the manufacturing process to achieve color variation of the light-transmitting plates (31). Further, each of the light-transmitting plates (31) has a surface on which patterns (34) are formed and may include various types of patterns, such as flames and stars and can be formed through printing or engraving.

The control circuit (4) comprises a control substrate (41), at least two light-emitting elements (42), and a connection wire (43). The light-emitting elements (42) are arranged to respectively correspond to the light incident surfaces (33) and are electrically connected to the control substrate (41) and the connection wire (43). The connection wire (43) allows for connection with a power supply to receive electricity therefrom in order to allow the control substrate (41) to drive the light-emitting elements (42) to lighten and darken according to a predetermined timing sequence. In the instant embodiment, the light-emitting elements (42) are light-emitting diodes (LEDs) and the number can be increased or decreased in accordance with the light-transmitting plates (31). The light-emitting elements (42) are controlled by the control substrate (41) to change the color of the light emitting therefrom in order to enhance the variability thereof.

It is noted here that in a condition that the power supply is conducted on, the light-emitting elements (42) are controlled by the control substrate (41) to lighten and darken according to the predetermined sequence and timing and lights (L) enter through the light incident surfaces (33) into and spread within the light-transmitting plates (31) to allow the light-transmitting plates (31) to show a flashing effect of intermittent brightening and darkening in response to the lightening and darkening of the light-transmitting elements (42) associated therewith.

Figure 5:
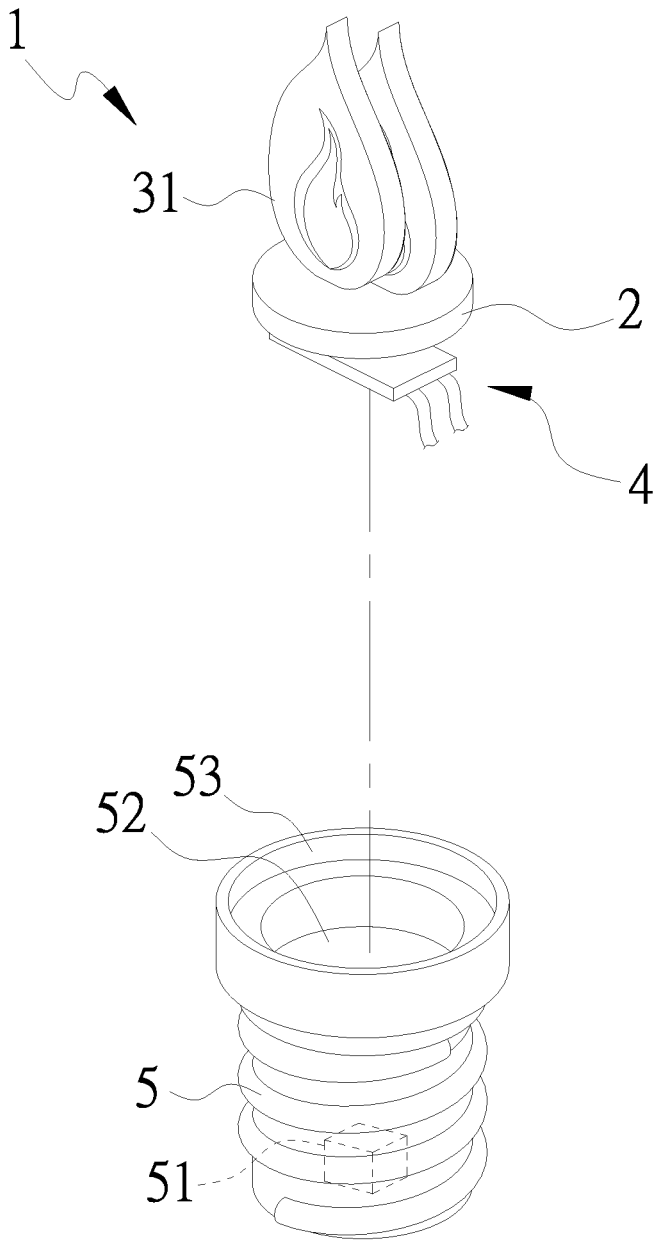
FIG. 5 is an exploded view showing a first embodiment of the present invention.
Figure 6:
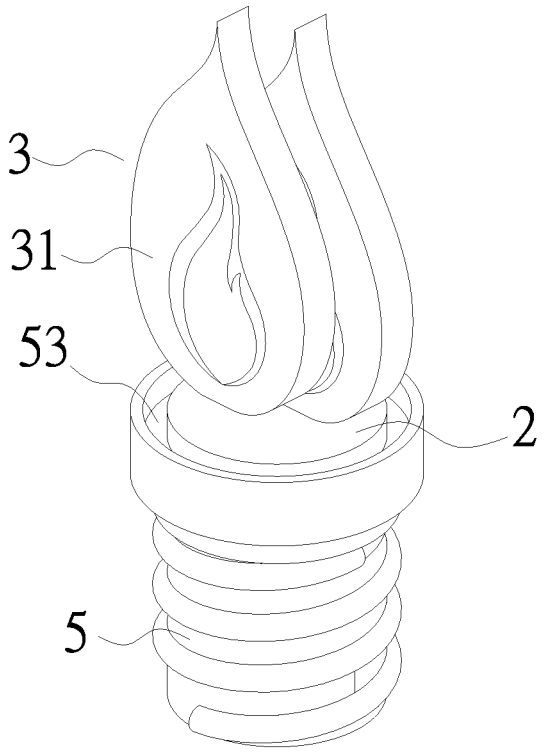
FIG. 6 is a perspective view showing the first embodiment of the present invention in an assembled form.

Referring to FIGS. 5 and 6, which are respectively an exploded view and a perspective view of a first exemplary embodiment of the present invention, the present invention may further comprise a light head (5). The light head (5) comprises a receiving space (52) in which a conductor unit (51) is arranged and an opening (53) in communication with the receiving space (52). The base (2) is securely mounted to the opening (53). The control circuit (4) is disposed in the receiving space (52) with the connection wire (43) electrically connected to the conductor unit (51). The conductor unit (51) can be any component that is arranged in a bulb base of a regular light bulb and no further detail will be given herein.

Figure 9:
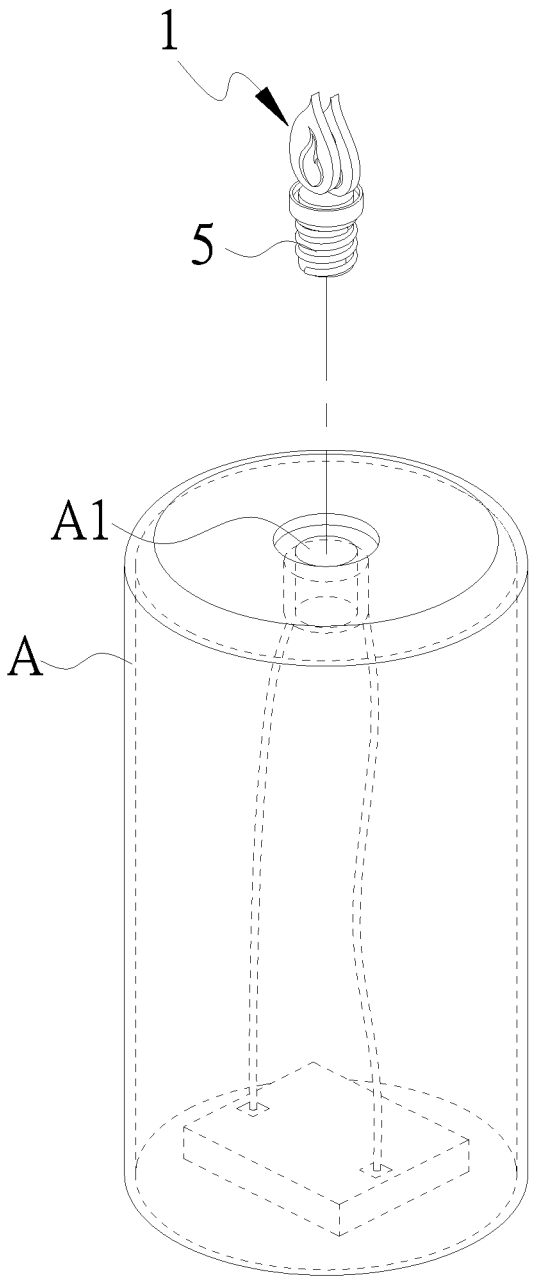
FIG. 9 is an exploded view showing the present invention applied to an electronic candle.
Figure 10:
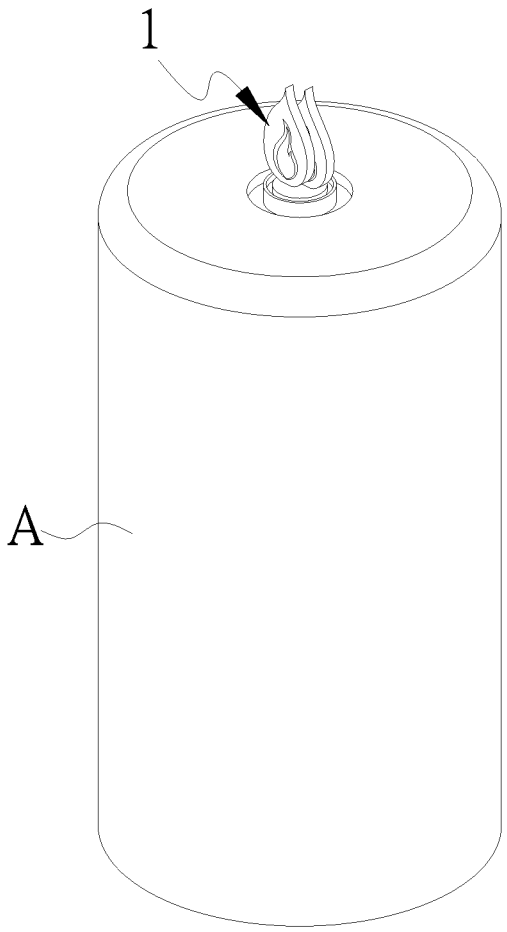
FIGS. 10 and 11 are perspective views showing the present invention applied an electronic candle in an assembled form.

As such, the instant embodiment provides a light head (5) that is arranged in such a way that a configuration resembling a light bulb is formed to be applicable to for example a night light or an electronic candle. As shown in FIGS. 9 and 10, the light head (5) is screwed and coupled to a bulb socket (A1) of an electronic candle (A) and lights from the light-emitting elements (42) irradiate the light-transmitting plates (31) so as to substitute a traditional light bulb. The light-transmitting plates (31) are of a design of a flame for the purposes of resembling a real candle flame.

Figure 7:
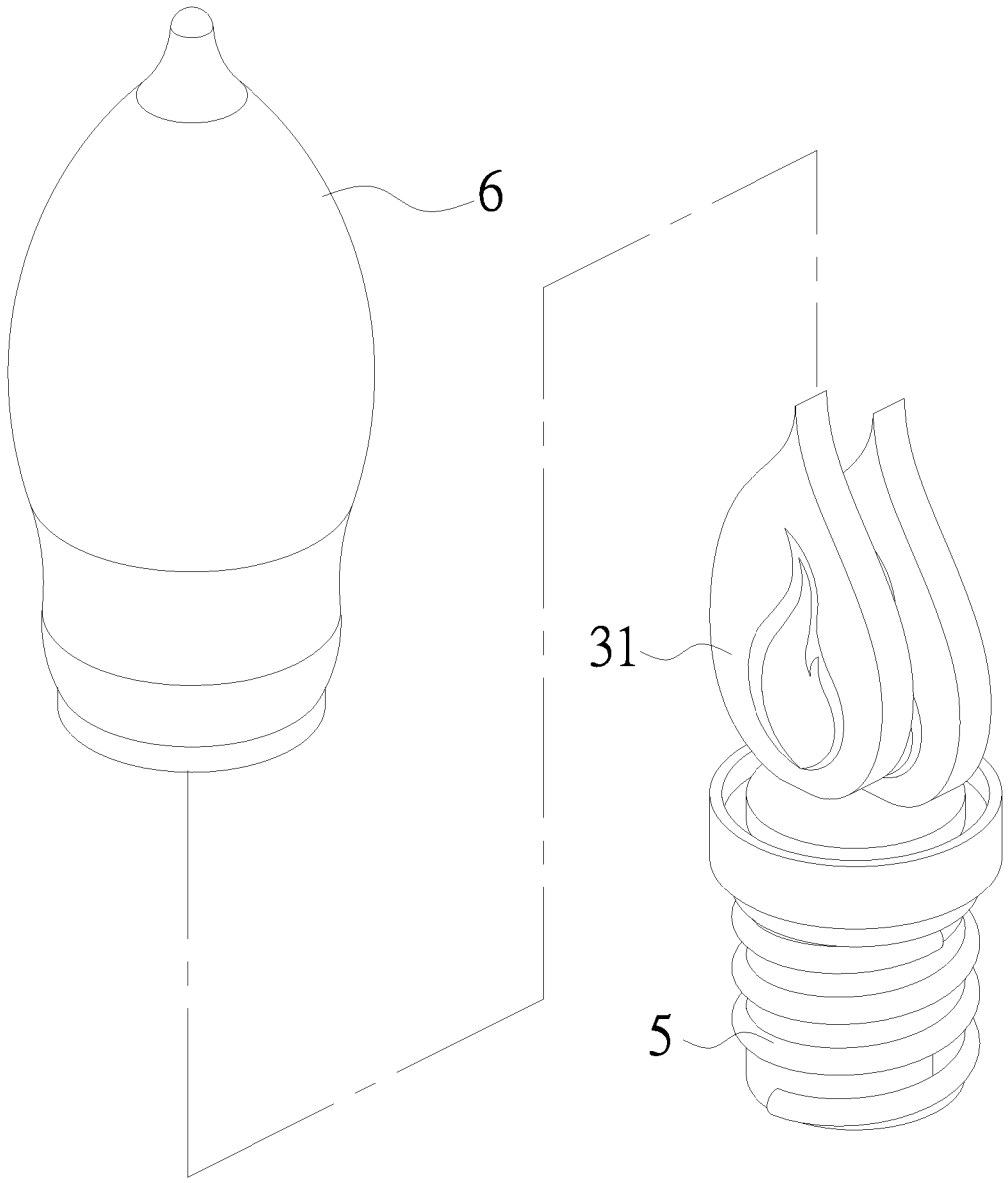
FIG. 7 is an exploded view showing a second embodiment of the present invention.
Figure 8:
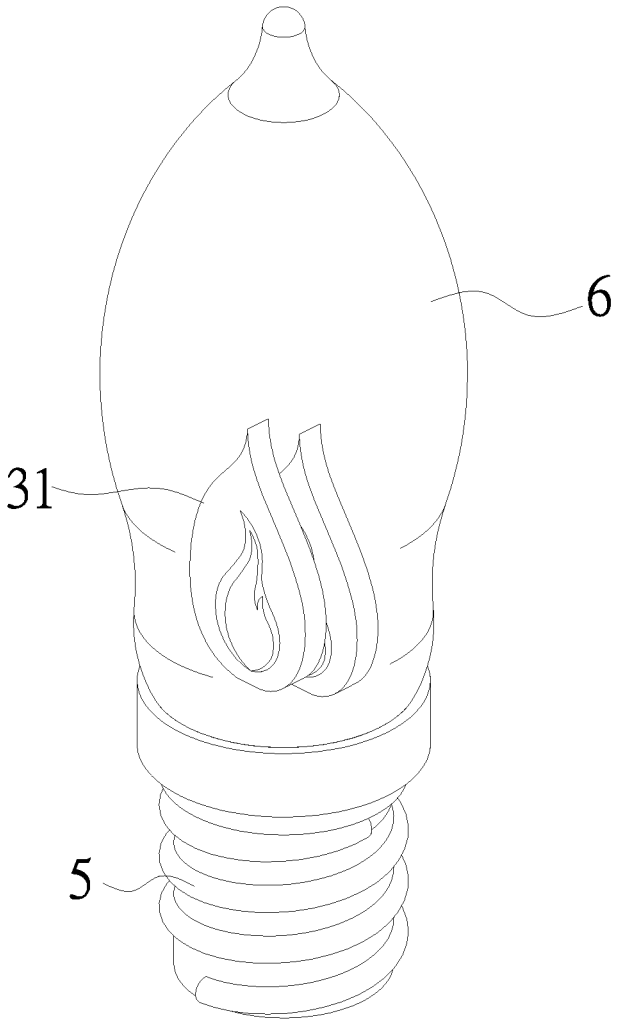
FIG. 8 is a perspective view showing the second embodiment of the present invention in an assembled form.

Referring to FIGS. 7 and 8, which are respectively an exploded view and a perspective view of a second exemplary embodiment of the present invention, the present invention allows for modification of the structure of the first exemplary embodiment by further including a light cover (6). The light cover (6) is in the form of a light-transmitting enclosure. The light cover (6) is arranged to cover and house outside the light-transmitting plates (31) of the light guide unit (3) and is fixed to the light head (4) or the base (2) to form a configuration of a light bulb. The instant embodiment does not impose any specific limitation to the outer configuration of the light cover (6) and in the drawings, a candle flame is used as an example for illustration but no limitation is imposed in regard to the material thereof, of which examples can be glass and plastics.

Figure 11:
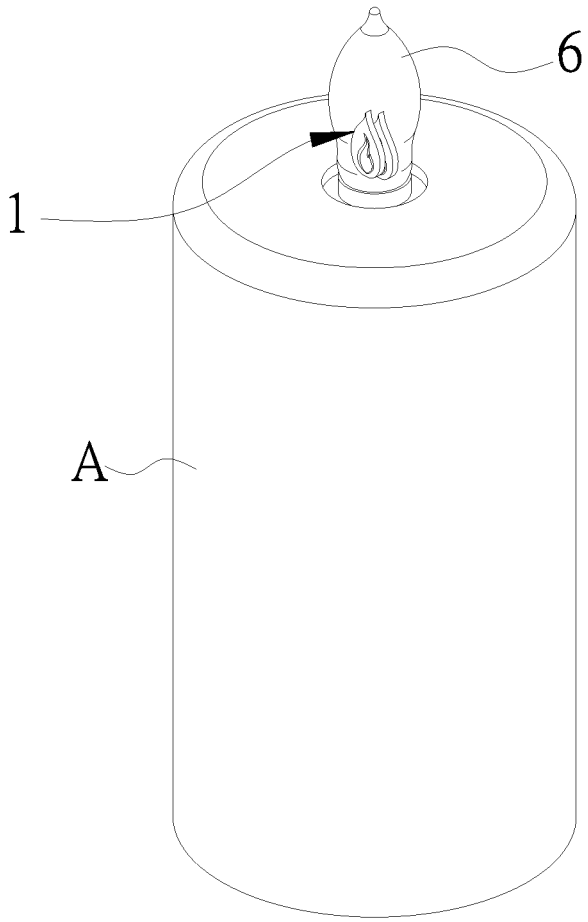
Figure 12:
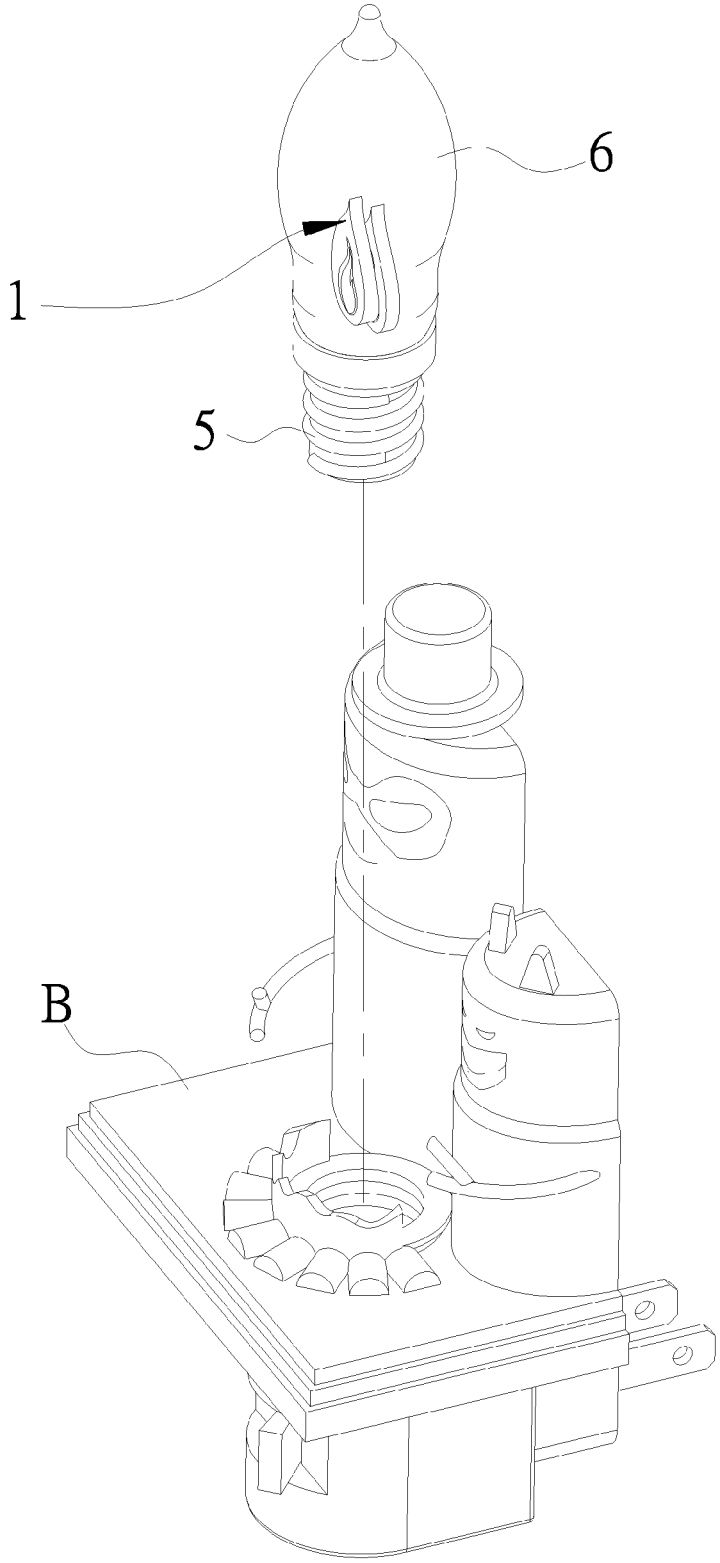
FIGS. 12 and 13 are respectively an exploded view and a perspective view of the present invention applied to an electronic candle.
Figure 13:
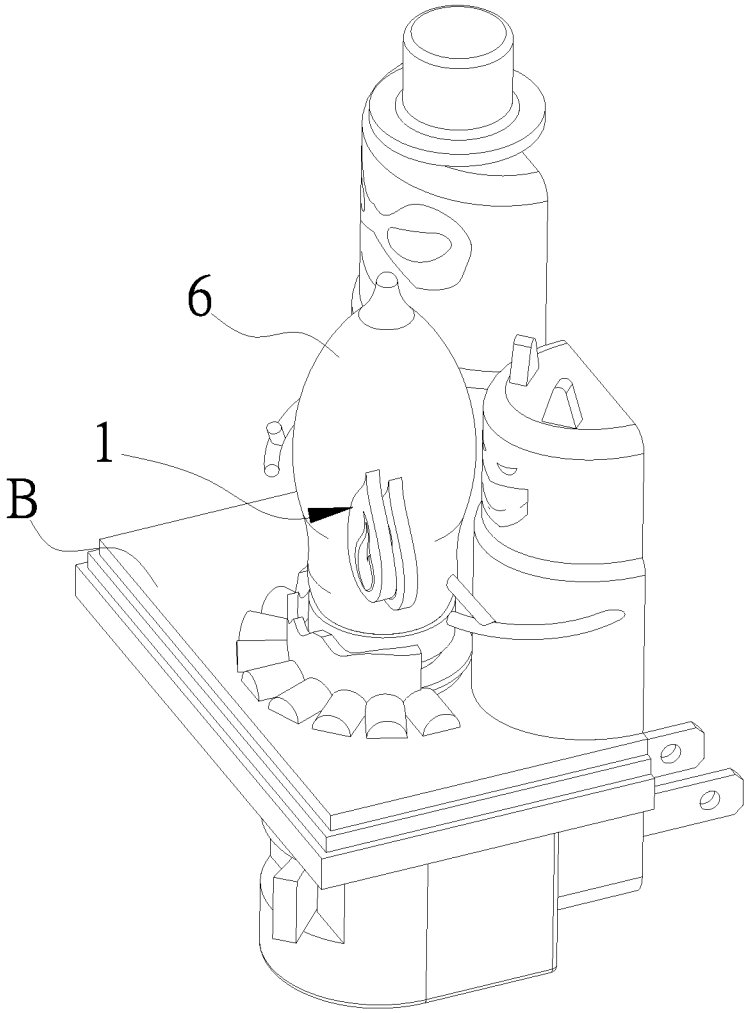

When made in the form of a light bulb, the present invention is of a wide application and may be used in combination with any lighting fixtures that include light bulbs, of which an example in shown in FIG. 11, in which an application to an electronic candle (A) is illustrated to replace a traditional light bulb so as provide a novel design of the electronic candle (A). Further, as shown in FIGS. 12 and 13, an application to a night light (B) having three-dimensional configuration is illustrated, in which the light-transmitting plates (31) are arranged to show an outer configuration of a candle flame to fully match the scenario exhibited with the three-dimensional configuration and also to provide an effect of lighting.

In summary, the present invention possesses the following advantages:

(1) The present invention provides light-emitting elements that change color of light so as to expand the variability thereof.

(2) The present invention provides light transmitting plates, which, if desired, can be added with colorants during the manufacture thereof, which, when irradiated with lights from light-emitting elements, greatly upgrades the visual effect of the present invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A flashing lighting module, comprising:

a base, which comprises at least two spaced mounting holes formed therein;

a light guide unit, which comprises at least two light-transmitting plates having a flame shape, each of the light-transmitting plates being a board having a thickness to allow light to transmit therethrough and having an end from which a fixing section extends, the fixing sections being respectively received in the corresponding ones of the mounting holes, the fixing sections each comprising a light incident surface at the side thereof opposite to the light-transmitting plate; and a control circuit, which comprises a control substrate, at least two light-emitting elements, and a connection wire, the light-emitting elements respectively corresponding to the light incident surfaces and electrically connected to the control substrate and the connection wire, the connection wire being adapted to be connected to a power supply to receive electricity therefrom in order to control the control substrate to drive each of the light-emitting elements to lighten and darken in a predetermined timing sequence.

2. The flashing lighting module according to claim 1, wherein each of the light-transmitting plates has a surface on which patterns are formed.

3. The flashing lighting module according to claim 1 further comprising a light head, the light head comprising a receiving space in which a conductor unit is arranged and an opening in communication with the receiving space, the base being securely mounted to the opening, the control circuit being disposed in the receiving space with the connection wire electrically connected to the conductor unit.

4. The flashing lighting module according to claim 1 further comprising a light-transmitting light cover, which is set to house outside the light guide unit to form a configuration of a light bulb.

5. The flashing lighting module according to claim 1, wherein each of the light-emitting elements are each controllable by the control substrate to change color of light.

6. The flashing lighting module according to claim 1, wherein each of the light-transmitting plates comprises a light-transmitting plate having a predetermined color.

* * * * *